US006106632A

United States Patent [19]

Ross et al.

[11] Patent Number: 6,106,632

[45] Date of Patent: Aug. 22, 2000

[54] PROCESS FOR MECHANICALLY DEWATERING EXTRACTED SUGAR BEET PULP

[75] Inventors: Guenther Ross, Klein Denkte; Ruediger Hille, Salzgitter-Ringelheim; Klaus-Michael Bliesener, Braunschweig; Rudolf Henze, Barsinghausen, all of Germany

[73] Assignee: Braunschweigische Maschinenbauanstalt AG, Braunschweig, Germany

[21] Appl. No.: 08/762,188

[22] Filed: Dec. 9, 1996

[30] Foreign Application Priority Data

Dec. 8, 1995 [DE] Germany ..... 195 45 803

[51] Int. Cl.[7] ..... C13J 1/06; C13D 1/00; D21C 3/00; D21B 1/16

[52] U.S. Cl. ..... 127/46.1; 127/43; 127/44; 162/13; 162/24; 162/26; 162/28; 162/189

[58] Field of Search ..... 127/43, 44, 46.1; 162/13, 24, 26, 28, 189

[56] References Cited

U.S. PATENT DOCUMENTS

| | | | |
|---|---|---|---|
| 2,332,062 | 10/1943 | Cutler | 127/43 |
| 3,100,725 | 8/1963 | Smart | 127/43 |
| 4,273,590 | 6/1981 | Cronewitz et al. | 127/44 |
| 4,499,823 | 2/1985 | Berry | 100/121 |
| 5,273,625 | 12/1993 | Antolovich | 162/60 |
| 5,653,815 | 8/1997 | Hartmann et al. | 127/43 |

FOREIGN PATENT DOCUMENTS 29 06 528 9/1980 Germany .

OTHER PUBLICATIONS

Patent Abstracts of Japan, "Method for Preparing Gypsum Solution Used as Auxziliary for Press–Hydration of Beet Pulp", 6–141900, May, 1994.

*Primary Examiner*—Mark L. Bell
*Assistant Examiner*—Patricia L. Hailey
*Attorney, Agent, or Firm*—Foley & Lardner

[57] ABSTRACT

In a process for mechanically dewatering extracted sugar beet pulp, the dry matter content in the pressed pulp is increased by introducing directly into the pressed pulp layer in the pressing region a suspension of salt or salts of polyvalent ions. An apparatus for this process is also disclosed.

10 Claims, 2 Drawing Sheets

PROCESS FOR MECHANICALLY DEWATERING EXTRACTED SUGAR BEET PULP

BACKGROUND OF THE INVENTION

The present invention relates to a process for mechanically dewatering extracted sugar beet pulp.

The energy needed to remove a defined amount of water is several times lower in mechanical dewatering process compared to thermal drying in conventional drum driers. Increasing the proportion of press water and thus the dry matter content of the pressed pulp represents considerable energy savings. In addition, there is the fact that saving primary energy is a critical factor in decreasing emissions.

The single- and twin-screw presses of vertical and horizontal type currently in general use for pulp pressing operate in accordance with the volume displacement principle, wherein the applied pressure and the pressing time are the relevant operating parameters for pressing. Improving the dry matter content in the pressed pulp by decreasing the spindle speed (in order thereby to increase the pressing time) leads to a decrease in throughput. Increasing the dry matter content by prolonging the duration of pressing thus inevitably leads to higher capital costs.

In practice, particular importance is attached to the use of pressing aids. These are taken to mean those additives or measures which—without decreasing the throughput of the pulp press—increase the dry matter content achieved in the pressed pulp. Pressing aids are, in particular, acids and gypsum which are added to the fresh extraction water or press water.

The press water pH during pressing promotes pressing-off if it is in the region of around 5.0. In addition to improving pulp pressing, however, the disadvantages associated with such measures must be taken into account, e.g., the increased molasses production due to ion exchange processes and the formation of calcium lactate. With excessive acidification, the dry pulp yield and the filter station in the juice purification stage can be adversely affected.

Addition via the press water or fresh water of salts of polyvalent cations as pressing aids is currently considered a standard technique. A gypsum solution is predominantly used, in such a quantity that the unesterified galacturonic acids of the pectin are occupied by calcium ions. DE-A 29 06 528 discloses a two-step pressing process in which salt solutions of polyvalent cations are added in an intermediate stage between the two pressing stages. This process, however, decreases the process throughput and efficiency.

The current mechanical pulp dewatering techniques used in practice remove only approximately 80% of the water introduced with the extracted pulp, achieving a dry matter content in the pressed pulp of on average approximately 30%. The remaining 20% of water must be removed by drying.

SUMMARY OF THE INVENTION

One object underlying the present invention is to provide an improved process for mechanically dewatering extracted sugar beet pulp.

A specific object of the invention resides in providing a process of this type which can increase the dry matter content in the pressed pulp without reducing the throughput of the pulp press.

In accomplishing these and other objects, there has been provided in accordance with one aspect of the present invention a process for mechanically dewatering extracted sugar beet pulp, comprising mechanically pressing, in a pressing region, extracted sugar beet pulp; and introducing in the pressing region, a suspension of one or more salts of a polyvalent ion directly into the pressed pulp layer.

In accordance with another aspect of the invention, there has been provided an apparatus for mechanically dewatering extracted sugar beet pulp, comprising: a mechanical press, having a pressing region, for pressing a layer of extracted sugar beet pulp; and an injection system for introducing, in the mid-section of the pressing region and directly into the pressed pulp layer, a suspension of one or more salts of a polyvalent ion.

Further objects, features and advantages of the invention will become apparent from the detailed description of preferred embodiments that follows, when considered together with the attached figures of drawing.

DETAILED DESCRIPTION OF PREFERRED EMBODIMENTS

Figure 1:
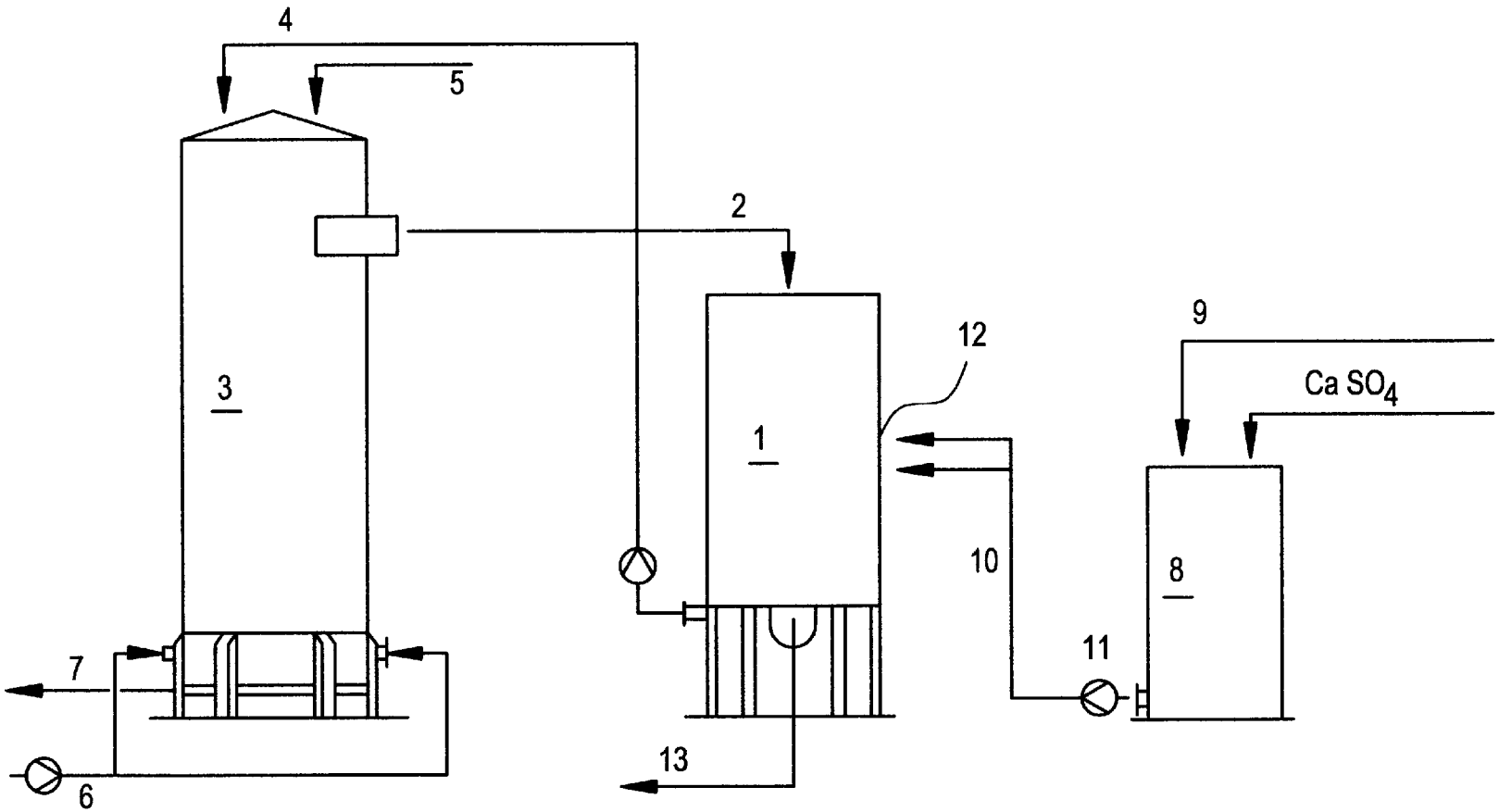
FIG. 1 is a process diagram depicting an exemplary embodiment of the invention.

According to the invention, a suspension of salt or salts of polyvalent ions is introduced in the pressing region directly into the pressed pulp layer, that is to say, preferably in the central region of the pressing path, after the majority of the press water has already been pressed off.

In the prior art, a gypsum suspension is fed into both the press water and the fresh water supplied to the extraction unit in an appropriate weight ratio, taking into account the solubility of gypsum (the solubility being achieved when a hardness of approximately 100° of German hardness is established in the extraction water). In contrast, according to the invention a suspension is introduced directly into the pulp press. A suspension containing 20–60% dry matter is preferably used according to the invention. To prevent the salt fed into the process from passing directly into solution, the suspension is not introduced until the majority of the press water has been pressed off. Feeding in this region leads to a significant increase in the internal friction and, associated therewith, higher torques at the press spindle and, as a result, to a significant increase of the dry matter content achieved in the pressed pulp.

The salt suspension introduced is substantially absorbed in the pulp, and the dispersed suspension thus remains in the extraction cycle. The extraction water treatment can thus be carried out via the rate of salt addition into the pulp press.

In the procedure according to the invention, the salt introduced into the pressing path, e.g. gypsum, is utilized twice, that is to say once mechanically by increasing the frictional forces, as described above, and secondly chemically, by a portion of the gypsum being dissolved by the press water and passing with it into the conventional extraction cycle and thereby increasing the dry matter content in the pressed pulp in a known manner via an ion exchange process.

The conventional addition of gypsum to the extraction water (fresh water and/or press water) can thus be omitted without replacement. In addition, it is possible in principle to use the same treatment device for the extraction water in the novel process. Consequently, by means of the modified gypsum addition to the pulp press, a marked improvement in the dry matter content of the pressed pulp is achieved without significant additional expenditure on equipment, and thus considerable cost savings in the thermal drying are achieved.

The gentle treatment of the pulp leads to a considerably lower formation of fine pulp, and thus also results in a lower dust content in the dried pulp.

The process of the invention may also be carried out using, e.g., carbo-lime, and thus provides for the disposal of waste substances arising in the sugar factory.

In the central region of the pulp press, if appropriate, additional pressing aids can further be added, in order to achieve further increase in the dry matter content by this means.

In order that the suspension introduced can develop its activity completely, it is expedient to introduce the suspension centrally into the pulp pressing layer thickness. It is advantageous in this case, when a screw press is used, if the suspension is fed at a plurality of peripheral points via restrictions. The feed is preferably performed under pressure in this case and with the use of at least one metering pump, by which the suspension feed can be controlled. At a constant rotary speed of the press spindle and thus constant pulp throughput through the press, the suspension feed can also be kept constant.

For the process of the invention, salts of divalent ions are preferably used, with gypsum having proved to be particularly advantageous. The gypsum suspension can be made in a conventional manner by mixing milk of lime and sulfuric acid in a stoichiometric ratio or else by mixing anhydrous gypsum into a portion of press water and/or fresh water. The rate of salt addition is preferably 2 m-equiv/100 g of beet (the equivalent is 0.17% of beet).

Figure 2:
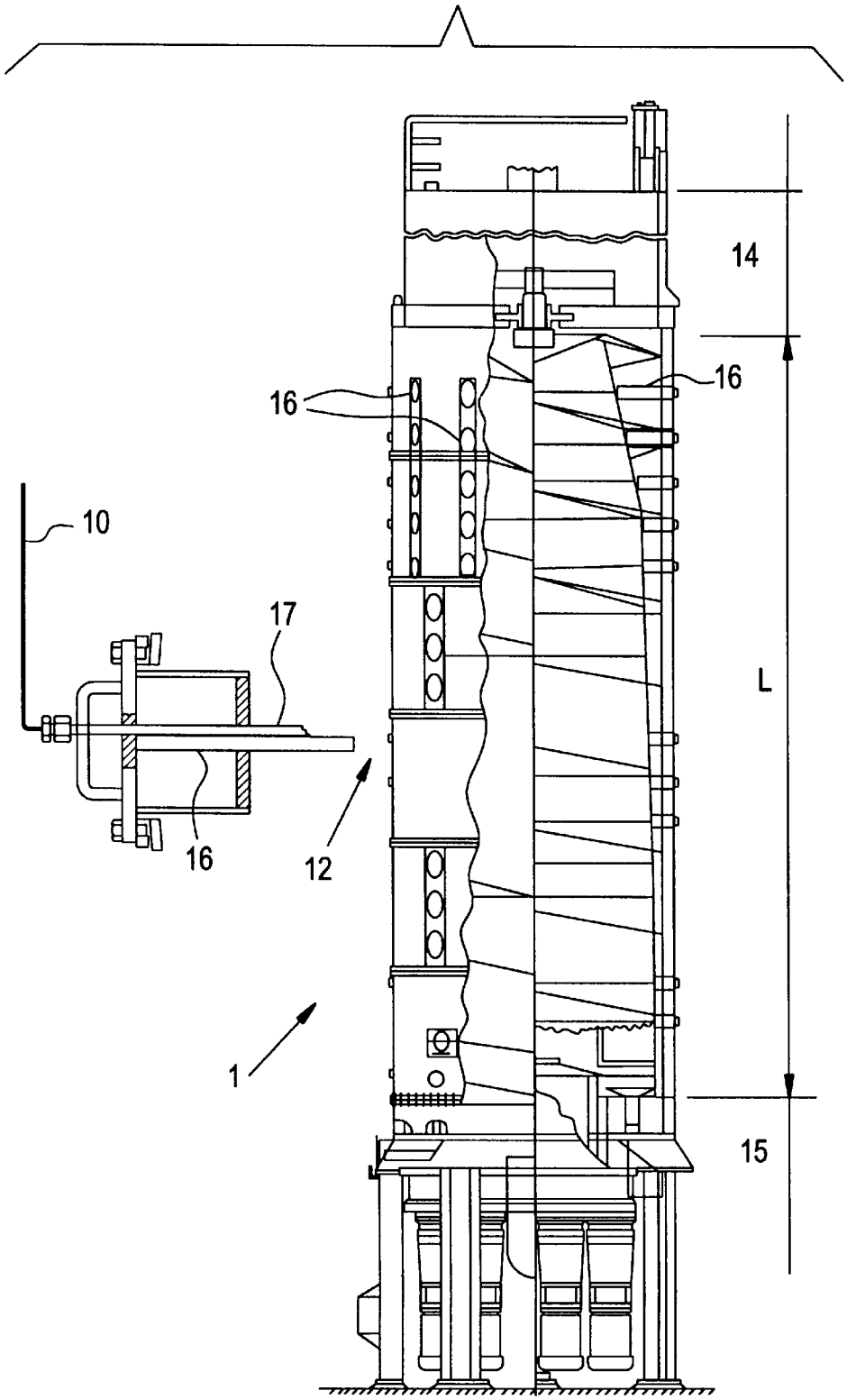
FIG. 2 is a vertical sectional view of a pulp press according to the present invention.

In FIG. 1 of the drawing, an exemplary embodiment of the invention is depicted in the form of a process diagram. FIG. 2 shows a vertical section of a screw press.

In the drawings, extracted pulp taken off from an extraction tower 3 via a line 2 is introduced into a pulp press 1 and pressed on its course through the pulp press 1. The press water arising in this operation is passed into the extraction tower 3 via a line 4 in addition to a fresh water feed S.

At the foot of the extraction tower 3, a pulp/juice feed 6 and a tower juice outlet 7 are indicated.

In a suspension tank 8, as a result of feeding water 9 and $CaSO_4$, a gypsum suspension of 20–60% dry matter is prepared which is fed via a line 10 from a metering pump 11 into a restriction or interruptor level 12 at a plurality of peripheral points of the pulp press 1. The suspension is fed centrally into the pulp pressing layer thickness, by means of interrupters or injectors that are not shown in more detail. This feed is performed roughly in the central region of the pressing path defined by the pulp press 1.

The extracted pulp fed into the pulp press 1 via the line 2 has a dry matter content of about 11%. The feed of gypsum suspension into the pulp press 1 is set in such a manner that a content of 2 m-equiv of $CaSO_4$/100 g of beet is provided in the press water pumped via the line 4 to the extraction tower 3.

The pressed pulp exiting from the pulp press 1 is represented by the arrow 13.

FIG. 2 shows a pulp press 1 comprising one double-thread screw mounted vertically in a housing. On top of said housing is an input 14 region for the beet pulp, which input region preferably comprises a bin for the beet pulp. On the bottom of the housing is a discharge 15 region for the pressed pulp, which discharge region comprises a ring channel, from which the pressed pulp is thrown out radially by blades not shown in greater detail. The pressing path or pressing length defined by the pulp press 1 between input region 14 and discharge 15 region is marked with a letter L.

In the wall of the housing, there are several interrupters 16 extending radially into the interior space of the housing to produce restrictions for preventing the beet from rotating together with the screw.

A gypsum suspension or other polyvalent salt suspension is fed via a line 10 from a metering pump 11 (see FIG. 1) into an interrupter level 12 at a plurality of peripheral points of the pulp press 1. This level 12 is located about half of the length L of the pressing region. The interrupter 16 is combined with an injection pipe 17 connected with said line 10.

Although the invention has been described and explained with reference to only a limited number of preferred embodiments, those skilled in the art will realize that various changes, substitutions and/or modifications are possible within the basic concept of the present invention. It is intended that all embodiments of the invention resulting from such changes, substitutions and/or modifications shall be covered by the appended claims.

What is claimed is:

1. A continuous process for mechanically dewatering extracted sugar beet pulp, comprising:

mechanically pressing, in a pressing region, a layer of extracted sugar beet pulp; and introducing, in the pressing region, a suspension of one or more salts of a polyvalent ion directly into the pressed pulp layer, wherein said suspension comprises a suspension containing from 20 to 60% dry matter.

2. A process as claimed in claim 1, wherein the suspension is introduced after the pressed pulp has travelled a sufficient distance in the pressing region so that a majority of the water has already been pressed off.

3. A process as claimed in claim 2, wherein the distance is at least about one half of the length of the pressing region.

4. A process as claimed in claim 1, wherein the suspension is introduced into a central region of the pressing path of the pressed pulp layer.

5. A process as claimed in claim 1, wherein a screw press is used, and the suspension is fed at a plurality of peripheral points.

6. A process as claimed in claim 1, wherein the suspension is fed by means of at least one metering pump.

7. A process as claimed in claim 1, wherein said salt of a polyvalent ion comprises gypsum.

8. A process as claimed in claim 1, wherein the gypsum suspension is prepared by mixing milk of lime and sulfuric acid in a stoichiometric ratio.

9. A process as claimed in claim 1, wherein the gypsum suspension is prepared by mixing anhydrous gypsum with a portion of press water and/or fresh water.

10. A process as claimed in claim 1, wherein said salt is added at a rate of about 2 m-equiv/100 g of beet.

* * * * *